US006819258B1

(12) United States Patent
Brown

(10) Patent No.: US 6,819,258 B1
(45) **Date of Patent: *Nov. 16, 2004**

(54) PERSONAL SHOE TRACKING SYSTEM

(75) Inventor: William W. Brown, Anderson, SC (US)

(73) Assignee: EworldTrack, Inc., Anderson, SC (US)

( * ) Notice: Subject to any disclaimer, the term of this patent is extended or adjusted under 35 U.S.C. 154(b) by 436 days.

This patent is subject to a terminal disclaimer.

(21) Appl. No.: 09/902,394

(22) Filed: Jul. 10, 2001

Related U.S. Application Data

(60) Provisional application No. 60/153,350, filed on Sep. 10, 1999.

(51) Int. Cl.[7] ..... G08B 5/22

(52) U.S. Cl. ..... 340/825.49; 340/825.36; 340/988; 340/989; 340/5.61; 340/5.64; 342/357.01; 342/357.06; 342/457; 701/213; 455/456.1; 455/457

(58) Field of Search ..... 340/825.49, 825.36, 340/988, 989, 5.61, 5.64; 342/457, 357.01, 357.06, 357.07, 357.09, 357.12; 701/213; 455/457, 456.1

(56) References Cited

U.S. PATENT DOCUMENTS

| | | | | |
|---|---|---|---|---|
| 5,043,736 A | | 8/1991 | Darnell et al. | 342/357 |
| 5,122,959 A | | 6/1992 | Nathanson et al. | 364/436 |
| 5,317,323 A | | 5/1994 | Kennedy et al. | 342/457 |
| 5,388,147 A | | 2/1995 | Grimes | 379/59 |
| 5,576,716 A | | 11/1996 | Sadler | 342/357 |
| 5,629,678 A | | 5/1997 | Gargano et al. | 340/573 |
| 5,712,619 A | | 1/1998 | Simkin | 340/539 |
| 5,731,757 A | | 3/1998 | Layson, Jr. | 340/573 |
| 5,742,233 A | | 4/1998 | Hoffman et al. | 340/573 |
| 5,812,087 A | | 9/1998 | Krasner | 342/357 |
| 5,835,907 A | | 11/1998 | Newman | 707/710 |
| 5,838,237 A | | 11/1998 | Revell et al. | 340/573 |
| 5,892,454 A | | 4/1999 | Schipper et al. | 340/825.37 |
| 5,905,461 A | | 5/1999 | Neher | 342/357 |
| 5,914,675 A | | 6/1999 | Tognazzini | 340/989 |
| 5,929,806 A | | 7/1999 | Birchler et al. | 342/357 |
| 6,014,080 A | | 1/2000 | Layson, Jr. | 340/573.1 |
| 6,131,067 A | * | 10/2000 | Girerd et al. | 701/213 |
| 6,392,565 B1 | * | 5/2002 | Brown | 340/988 |
| 6,453,168 B1 | * | 9/2002 | McCrady et al. | 455/517 |

* cited by examiner

*Primary Examiner*—Ario Etienne
*Assistant Examiner*—Yves Dalencourt
(74) *Attorney, Agent, or Firm*—McNair Law Firm, P.A.; Cort Flint

(57) ABSTRACT

A system for tracking a person from a system subscriber who affixes a location unit to the person to be tracked is provided wherein the location unit calculates the location of the person at any given time. The system includes a web host connected to a wide area web network, such as the Internet, the web host includes a computer readable medium and is accessible by the subscriber from a remote computer terminal. A computer program resides on the web host for receiving a tracking request from the subscriber and transmitting a tracking call to the location unit carried by the person. The computer program includes instructions embodied in computer readable code for automatically transmitting the tracking call, receiving location data from the location unit in response to the tracking call, and transmitting the location data to the subscriber's terminal where the current location of the person is displayed.

35 Claims, 7 Drawing Sheets

PERSONAL SHOE TRACKING SYSTEM

This application claims the priority of U.S. Provisional Application Ser. No. 60/153,350 filed on Sep. 10, 1999, entitled Multi-User Global Position Tracking System and Method and Ser. No. 09/497,733 filed on Feb. 4, 2000, entitled Multi-User Global Position Tracking System and Method which applications are hereby incorporated in this disclosure by reference.

BACKGROUND OF THE INVENTION

The invention relates to a system and method for tracking persons, and particularly to a system and method for tracking a person's shoe through the use of a global positioning system implanted into the heel of a shoe to be worn by a person to be tracked.

There is no question that families today are extremely active and busy, often with both parents working full time and their kids engaged in multiple activities. With such an active lifestyle, a lack of communication often develops and the safety of family can become an issue. The advent of cellular phones provided an excellent method of staying in communication with people despite their busy schedules. However, for children, especially younger children, cellular phones are not a very practical tool for keeping track of their location and safety. They are often complicated to use and are likely to be lost or broken. Thus, what is needed is a automated portable device that will transmit information about the location of a person, particularly a child, that is simple and reliable.

Accordingly, an object of the invention is to provide a system and method for tracking and locating persons.

Another object of the invention is to provide a personal tracking system that is concealed in an article worn by a person so that the device is not a bother and can be easily transported with the person.

Another object of the invention is to provide a personal tracking system that does not require a user to turn the location unit on or off.

Another object of the invention is to be able to provide accurate location information to parents about their children's whereabouts for their children's safety.

Still another object of the invention is to provide a system and method wherein multiple persons can be concurrently tracked and located.

SUMMARY OF THE INVENTION

The above objectives are accomplished according to the present invention by providing a web host connected to a wide area web network, wherein the web host has a computer readable medium. A computer program is stored on the web host for connecting a location unit subscriber to the network. A unique location unit is carried by a person, preferably in the person's shoe. The location unit includes a GPS chip for calculating the position of the person. The location unit includes a processor for accessing location data calculated by the GPS chip. A transceiver included in the unit is controlled by the processor to automatically answer a tracking call from the web host, transmit location data representing the current position of the person back to the web host, and then hang up. Any one of a number of users who subscribe to the network may concurrently send tracking requests to the web host wherein the web host automatically sends out tracking calls to each identified person/location unit, receives the current locations of the persons from the location units, and transmits location data to the subscribers for display at the subscribers' computer terminals. The location unit is integral and inconspicuously concealed within the heel of a shoe to be worn by a person to be tracked.

The personal tracking system and method uses cutting edge technology with GPS and wireless web design. The shoe location unit reads its location off GPS satellites every 15 seconds and keeps its last location in memory. When one goes online to locate a person, the web host contacts the shoe location unit and pinpoints its exact location on a map, all in less than two minutes. Since GPS cannot track inside a building, if a person enters inside a building, the web host will contact the location unit and draw a map taking one to the front of the building where the person is located. A 24 hour tracking center may be provided that will track persons for those subscribers not connected to the Internet, or other wide-area network.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
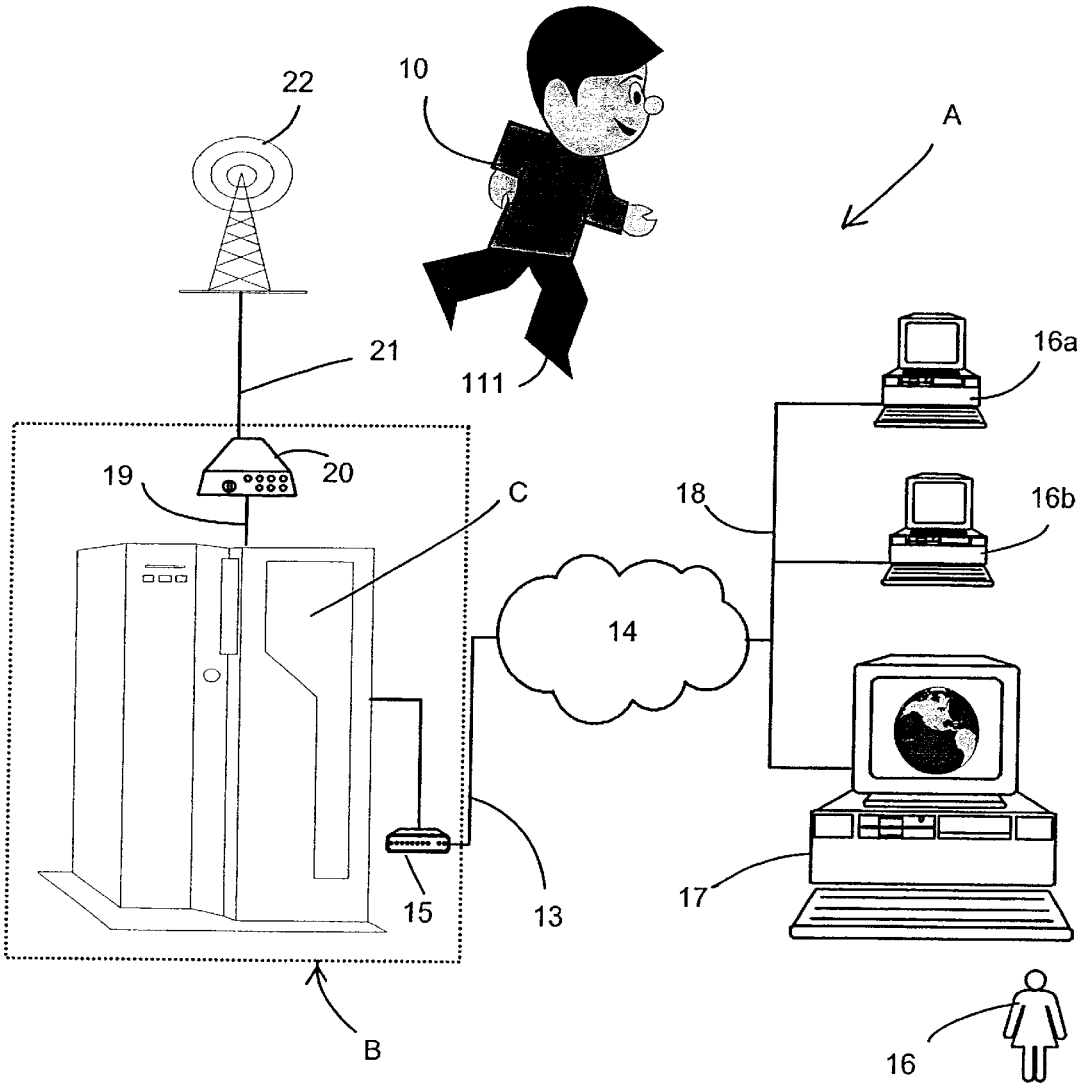
FIG. 1 is a schematic view illustrating a personal tracking system according to the invention.

The detailed description which follows is presented in terms of program procedures executed on a computer or a network of computers. These procedural descriptions and representations are the means used by those skilled in the art to most effectively convey the substance of their work to others skilled in the art. An object or module as herein described is generally a self-consistent sequence of steps leading to desired results. These steps are those requiring physical manipulations of physical quantities. Usually, these quantities take the steps of electrical or magnetic signals capable of being stored, transferred, combined, compared or otherwise manipulated. More specifically, an object or module is a section of computer readable code which is designed to perform a specific task or tasks. Actual computer executable code need not be contained with one file or one storage medium to constitute an object or module. Objects or modules generally receive input and provide output. The objects or module may receive information passed by another calling object or module and may output information to the calling object. A web host is computer hardware capable of creating and processing computer readable instructions and is not limited to a single computer. For example, mass storage, network communications, and main processing could be executed by three physically separate computers and would still constitute a web host. Therefore, the term "web host" is not intended to be limited to a single computer. Packets are electronic messages or information together with an Internet address which are sent as one unit. A datagram is a complete message and can be sent in many or one separate packet. With these terms in mind, the preferred embodiment is described in more detail.

Referring to the drawings, an Internet based personal tracking system, designated generally as A, is illustrated for tracking the position of a person 10 to which a location unit 12 is affixed. As can best be seen in FIGS. 6, and 9–10, the location unit is carried in a heel of the person's shoe for tracking the position of the person. The tracking system includes a web host B connected to the Internet 14, or other wide area network, through a network connection device 15. A computer program C runs on web host B and receives a tracking request from a subscriber or user 16 through the user terminal 17. The web host receives location data from location unit 12 through a cellular network 22 and a modem 20; and makes the location data accessible by subscriber 16 through the subscriber's terminal 17.

As best can be seen in FIG. 1, web host connection 13 to the Internet 14 allows a multitude of subscribers 16, for example 16*a*, 16*b*, etc., to simultaneously access web host B. Each subscriber has a connection 18 to the Internet allowing access to the web host. The term "subscriber" means anyone with authorized access to the web host, whether payment is exchanged or not, e.g. any authorized user of the system or method. In addition to a connection with the Internet, web host B has a communication connection 19 for connecting the web host to a modem 20. Modem allows web host B to initiate cellular tracking calls to shoe location unit 12. When dialing cellular numbers, modem 20 connects to a cellular network 22 through a line 21. The web host can then transmit and receive data from location unit 12 through cellular network 22 allowing for location unit 12 to send location data to web host B.

Figure 2:
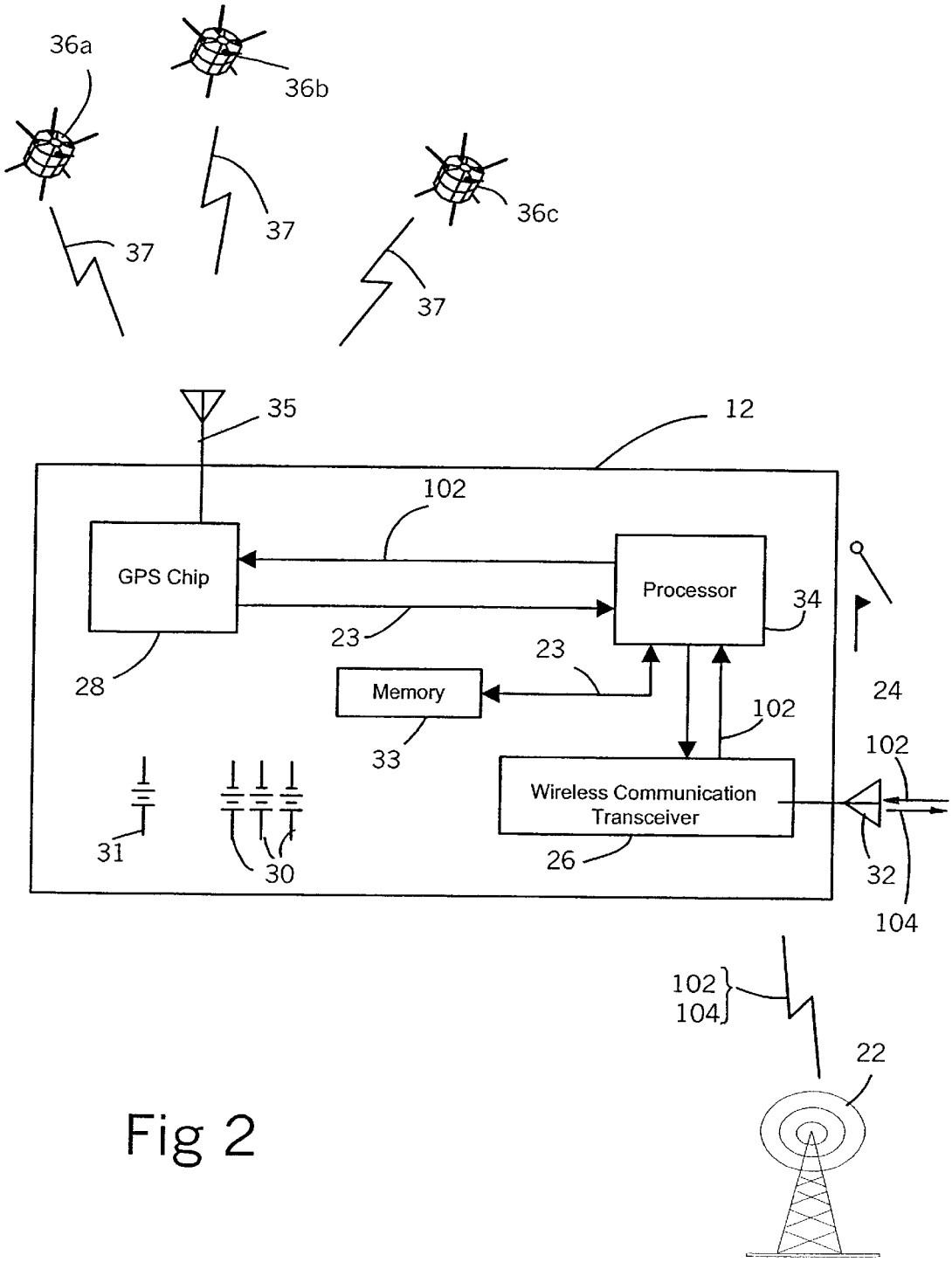
FIG. 2 is a schematic illustration of a wireless location unit and system for use in a personal tracking system according to the invention.

Shoe location unit 12 is further illustrated in FIG. 2. In order to provide the functionality required for a subscriber to track a person, location unit 12 may be a simple GPS based device using digital cellular communications. Location unit 12 includes a location chip, typically a GPS chip 28 carried within an enclosure for reading information from a global positioning satellite system. Global position satellites 36*a*–36*c*, generate signals 37 which are received through an antenna 35 of unit 12 and forwarded to GPS chip 28. Any suitable GPS chip may be utilized such as a model Superstar (with antenna), available from Canadian Marconi of Quebec, CN. GPS chip 28 passes the information to a processor 34. Processor 34 then may calculate latitude, longitude, and altitude of the device and, therefore, of the person. Once calculated the position information is transmitted to a cellular network 22 by a wireless transceiver 26 using a wireless communication antenna 32. Memory 33 may be included within location unit 12 to hold a number of previous GPS readings which can be used to show the prior path or track of the location unit and tracked person, as disclosed in the above application. Other, non-GPS, location calculating methods and chips may also be utilized. Processor 34 is programmed to control location unit 12 on stand-by, automatically answer a position inquiry from a concerned user, poll the GPS chip and received GPS position information, transmit the position information to the host, terminate the call, and return to stand-by.

Location unit 12 can be powered by a stackable power supply 30. Stackable power supply 30 may include stackable thin film batteries as have been recently developed for the cellular market. Since the location unit 12 only receives a tracking request and transmits location data, the power required is significantly less than the traditional cellular phone. With this advantage, as well as eliminating the need for voice communication, location unit 12 requires less power and may be a significantly smaller unit than the traditional cellular phone.

The GPS chip creates tracking information 23 which includes the latitude and longitude of location unit 12. Tracking information 23 is transmitted via transceiver 26 over lines 24, and may be stored in memory 33. Transceiver antenna 32 transmits the tracking information in the form of location data 104 to remote relay antenna 22. Any suitable transceiver device may be utilized, such as that available from Motorola of Schaumburg, Illinois, Model 650. GPS chip 28 reads the tracking signals of the locator device at any desired interval, such as every 30 minutes. The GPS chip may be adjustable so that the reading interval may be adjusted as desired. The transceiver 26 is on standby at all times. The processor/memory can store a predetermined number of the GPS readings, for example, the previous 100 readings. It is advantageous to store a predetermined number of previous readings in the event a tracked person is inside a building or other environment in which it is not possible to receive satellite signals and obtain GPS readings. In this case, when the shoe location unit is called, a trail of the past 2 days positions can be downloaded to the base station to help pinpoint the person's current location.

When a tracking call 102 is received from the web host in order to determine the location of the shoe, and the person wearing the shoe, the transceiver automatically answers the call and activates processor 34. The processor is programed to automatically retrieve the person's location tracking information stored in the processor chip and transmit location data 104 to web host B. The programming of the processor will be well within the purview of the average artisan in the automatic programming art having been taught the expedients and operation of the present invention. At the web host B, shown in FIG. 1, the digital location data 104 is received by modem 20 wired to computer 38.

Figures 6, 7:
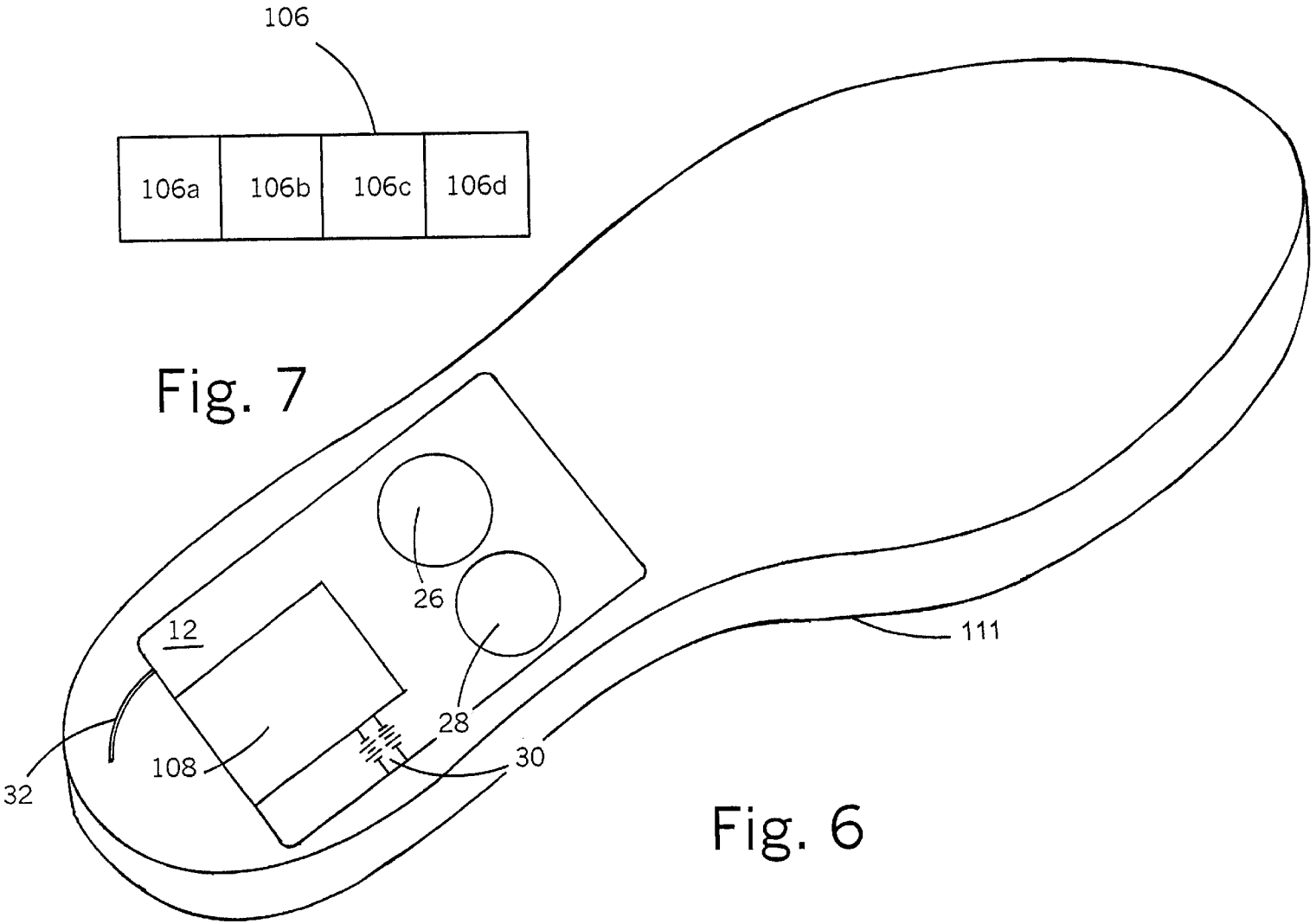
FIG. 6 is an illustration of a location unit incorporated into a shoe according to the invention.
FIG. 7 is a schematic illustration of a digital data packet containing location data according to the invention.

In accordance with the invention, digital location data 104 which is output by location unit 12 is in a special format so that low power requirements are needed to transmit the signal. The signal is purely a data signal and contains no voice or sound. Since there is no voice, the unit outputs only a very small digital location data packet. For example, as shown in FIG. 7, location data 104 may include a small digital data packet 106, containing only protocol data 106*a*, a unit code number 106*b* identifying the subscriber to which the locator unit is assigned, longitude data 106*c*, and latitude data 106*d*. Therefore low power is required to transmit the data. The high power requirements associated with analog sound and voice transmission of full cellular transmissions are eliminated. For example, transceiver antenna 32 may only require 0.6, or even 0.3, watts. Means for powering GPS chip 28, processor 34, and transceiver 26 may be provided by a miniature rechargeable battery system designated generally as 30. The rechargeable battery system may be a miniaturized, lightweight version of a lithium ion battery and recharging system such as disclosed in U.S. Pat. No. 5,742,233 or may be recently developed thin film battery technology.

While the digital telephone system is preferred, national coverage may not presently exist for digital technology. When national coverage does exist, the digital technology will provide an advanced location system which will have faster and more long distance communication and longer battery life. However, for the present, the wireless communications between the location unit 12 and the web host B may be had using cellular analog transmissions. Cellular telephone systems currently provide national coverage necessary to allow the location device to function on a national basis.

Transceiver 26 remains in a standby, power reducing mode until the web host initiates tracking call 102. The web host sends out the cellular tracking call and the transceiver automatically answers the call, and transmits location data representing the present coordinates to the web host. The transceiver then automatically hangs up and returns to standby. The location unit can also transmit previously stored coordinates to the base station as described above. For this purpose, processor 34 may be programmed to send either the current location data, the location history which includes all the stored locations, or any number of the stored locations. The unit may be programmed to send the desired location data depending on a corresponding tracking call request from the web host.

Figure 4:
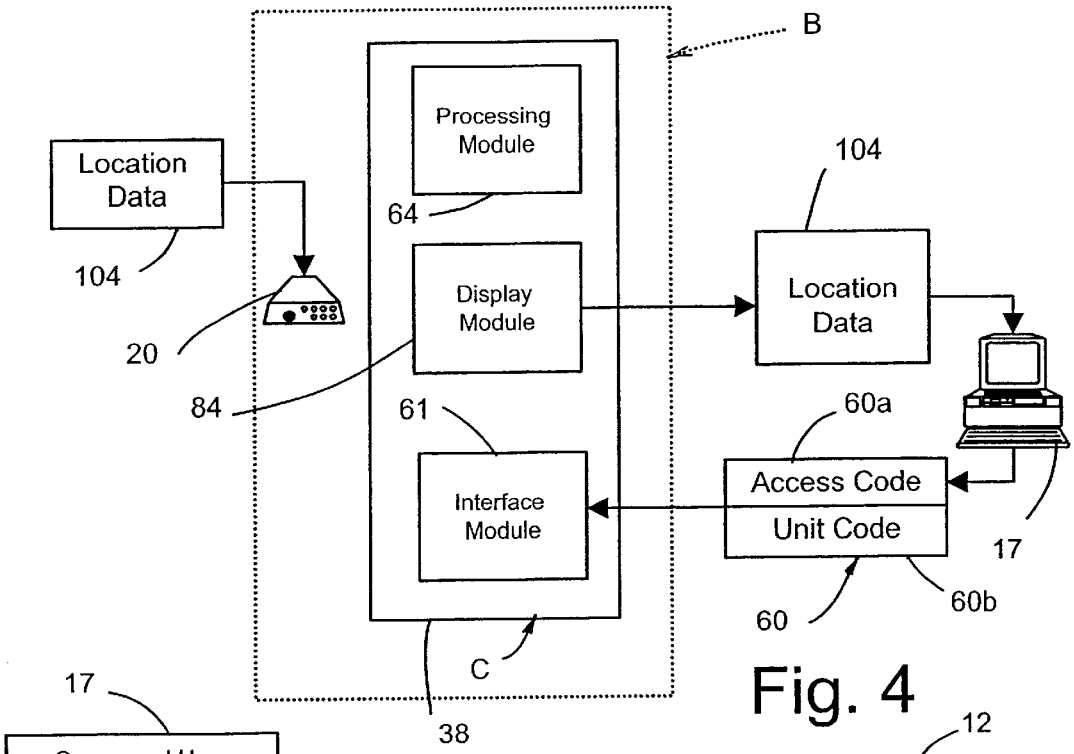
FIG. 4 is a schematic diagram of a web host and computer program for a personal tracking system according to the invention.

FIG. 4 illustrates the basic components of web host program C which accomplishes these tasks. The web host program comprises a set of computer readable instructions embodied in a computer readable medium located on the web host computer 38. To initiate a tracking call, the program receives a tracking request datagram 60 generated by subscriber terminal 17 sent to web host B. Datagram 60 includes a unique access code 60*a* and an unique unit code 60*b* supplied to the subscriber. The program includes an interface module 61 which includes the instructions necessary for terminal 17 to communicate with web host B. Interface module 61 passes request datagram 60 to a process module 64. Processing module 64 includes a set of instructions for receiving datagram 60, validating the access and unit codes, and requesting and receiving the GPS location data for making the same available to the subscriber, as more fully described below.

Figure 5:
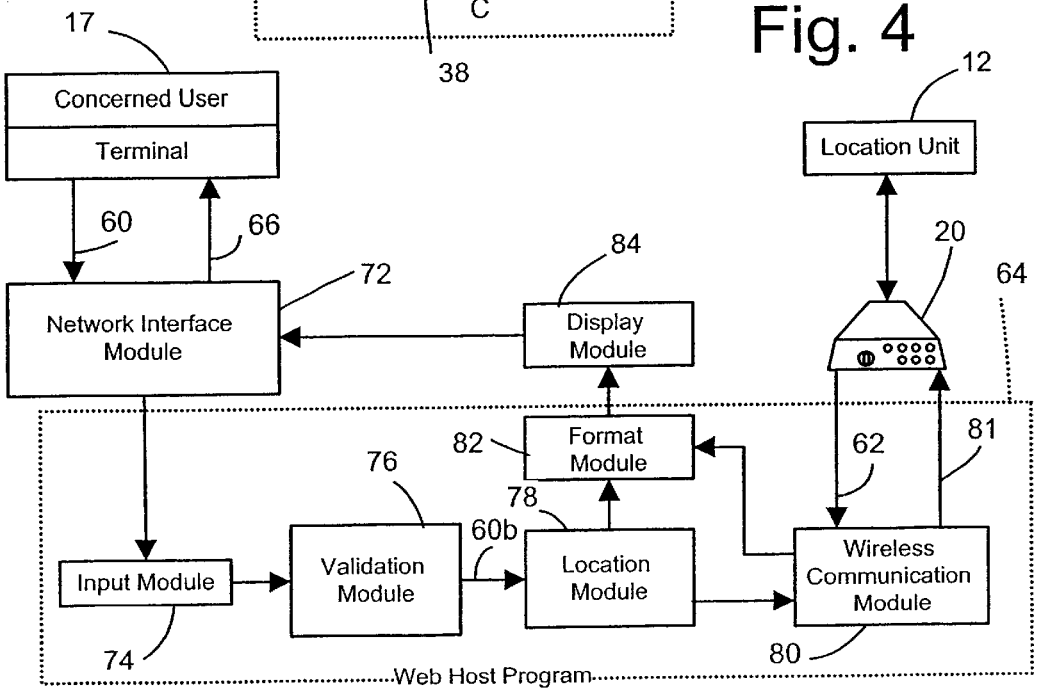
FIG. 5 is a schematic diagram of the modules contained with the computer program residing on the web host of a personal tracking and system according to the invention.

As best can be seen in FIG. 5, processing module 64 includes an input module 74 for receiving tracking request datagram 60. There is a validation module 76 having instructions for receiving the access code and determining if the access code is valid and whether processing can continue. There is a location module 78 which receives unit code 60*b* for further processing if the processing continues. Location module 78 includes a set of instructions for initiating wireless communication through a wireless communication module 80. Wireless communication module 80 includes instructions for polling location unit 12 by making a cellular phone call through modem 20. Connected wireless communication module 80 sends a tracking call datagram 81 which is received by transceiver 26 of location unit 12. Wireless communication module 80 also includes the instructions for receiving and processing GPS position data and forwards this data to a format module 82. The format module includes instructions which create position information 66 and provides a user readable representation of the position of person 10 such as a map display or position coordinates. A display module 84 includes a set of instructions to create a datagram containing location unit position information 66 to be accessed by the subscriber's terminal 17. Network interface module 72 includes instructions for receiving position information 66 and allowing the subscriber to know and/or display the global position of the person being tracked. Location unit 12 responds to tracking call datagram 81 by determining its global position through satellites 36*a*–36*c* (FIG. 2) and temporary stores this tracking information. Location data 104 is then transmitted back through modem 20 to wireless communication module 80 by line 62.

Figure 3:
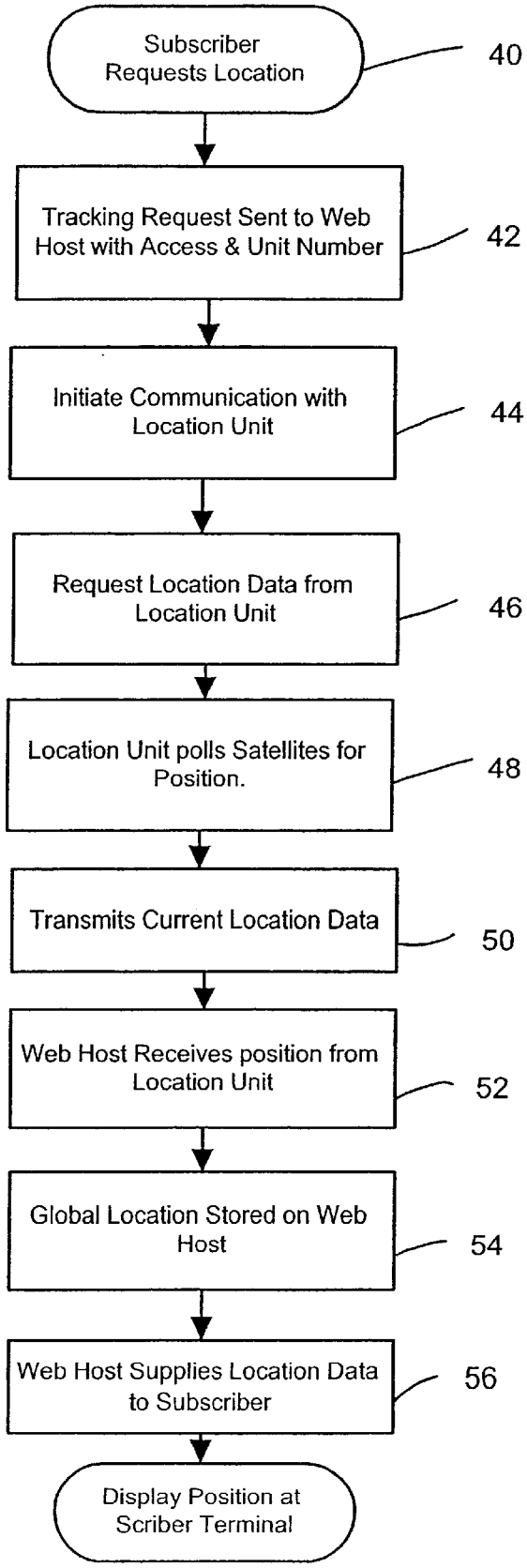
FIG. 3 is a process flow diagram illustrating a personal tracking system according to the invention wherein a network subscriber can access a web host for tracking a person.

In use, as can best be seen in FIG. 3, subscriber 16 can discover the global position of person 10, through the person's shoe, by accessing web host B through terminal 17 connected to web host B by the Internet. To do this, the subscriber enters a domain name for web host B such as www.satcel.com in step 40 of FIG. 3. When the remote user enters a domain name, a datagram is created at terminal 17 and transmitted across the Internet, from the subscriber to the web host, which contains the Internet addresses of the user. At this point, the subscriber enters a tracking request which includes system access number 60*a* and a subscriber unit code 60*b* which is unique to shoe location unit 12. At step 42, a datagram is created containing the subscriber's input and sent to the web host. Upon receiving the remote user's request, the web host initiates communication with the shoe location unit at step 44 by initiating a cellular telephone call to the shoe location unit. The shoe location unit answers the call without any further action, nor with any notification to the individual carrying the location unit. The web host sends a small compressed digital packet requesting the global position of the location unit. Such a packet need only include a single character or two, as discussed above.

Figure 8:
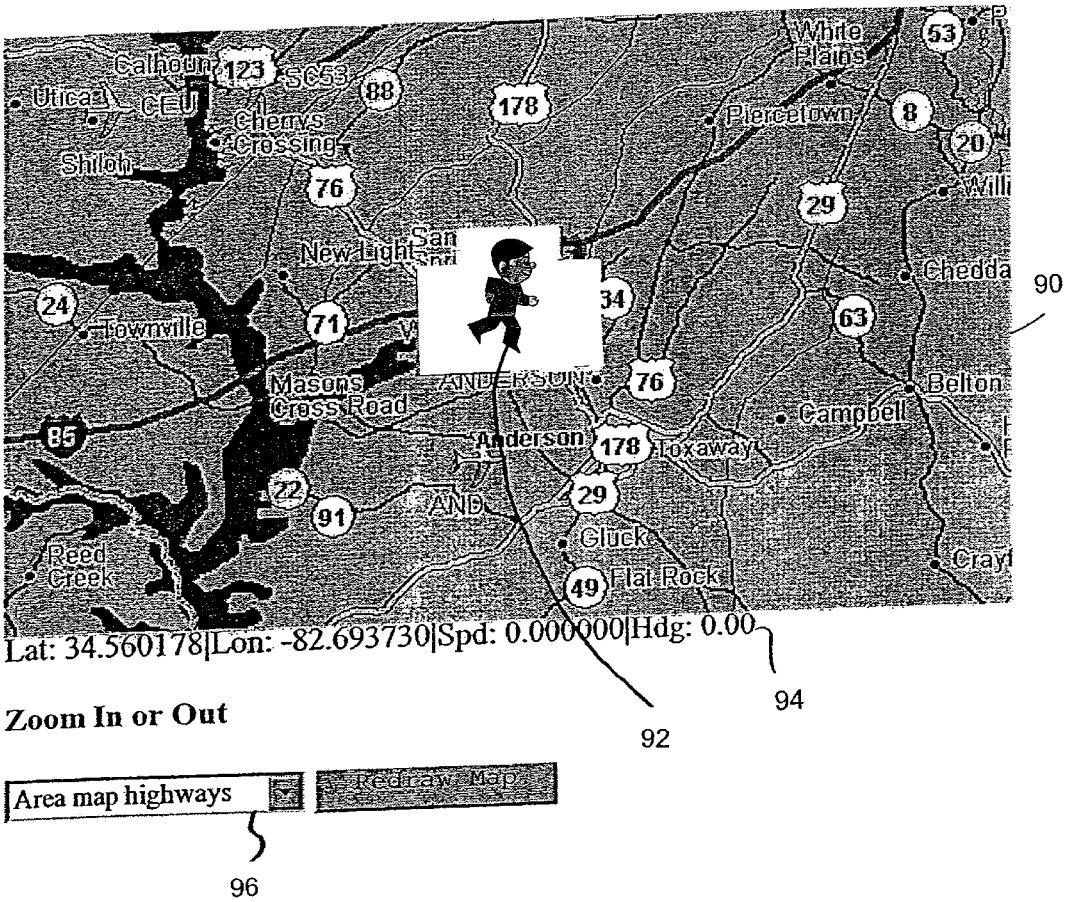
FIG. 8 is a representation of a user terminal display according to the invention.

Once communication with the location unit is initiated, the web host requests location data from the location unit at step 46. The location unit then polls GPS satellites for determining its global position at 48. The GPS satellites transmit the location data and the location unit receives the data at step 50. The location unit then constructs a packet containing the global location data and sends the packet back to the web host. The web host receives the location data and stores the information at 52 either in permanent or temporary memory. At this point, cellular communication is terminated. At 54, the web host formats the global position of the individual based upon the stored location data. The results of the formatting would be a map display, street address or position coordinates. Once this formatting is complete, the web host makes the global position information available to the subscriber user at 56. The web host, associating the location unit number and subscriber's Internet address, constructs datagram 60 (FIG. 4) containing the person's location. This datagram is sent to the subscriber's terminal across the Internet. The subscriber receives the datagram and a display of the global position of the person is created at the subscriber's terminal. Once the initial map is displayed the user has the option to zoom in or out on the position of the tracking unit. FIG. 8 shows a representation of the display at the user's terminal once the shoe location unit has been found. Map 90 shows the global position of the location unit by icon 92. Beneath the map contains geocoordinates 94 showing latitude, longitude, speed and the heading of the location unit. By using drop-down bar 96, the subscriber can select from displaying the entire United States to displaying the specific location at the street level of the person wearing the shoe and being tracked.

While the Internet is the preferred and most expedient method of providing communication between the subscriber and the web host, multi-user networks including Local Area Networks or Wide Area Networks using such communication connections as dial-up, ISDN, Ethernet, token ring, FDDI or other connection methods well known in the art would also provide such a communication connection. Additionally, while cellular communication is the preferred and most expedient method of providing communication between the web host and location unit, any wireless communication such as satellites, microwave, or infrared would provide such wireless communication. The location data received by the location unit 12 from the GPS satellites 36*a*–36*c* can be converted into the global position of the person either at the shoe location unit itself or the raw position data can be passed to the web site and the global position calculated there. Additionally, position data may be derived from sources other than GPS such as GLONASS, Triangulation, or signal strength determination.

Figure 9:
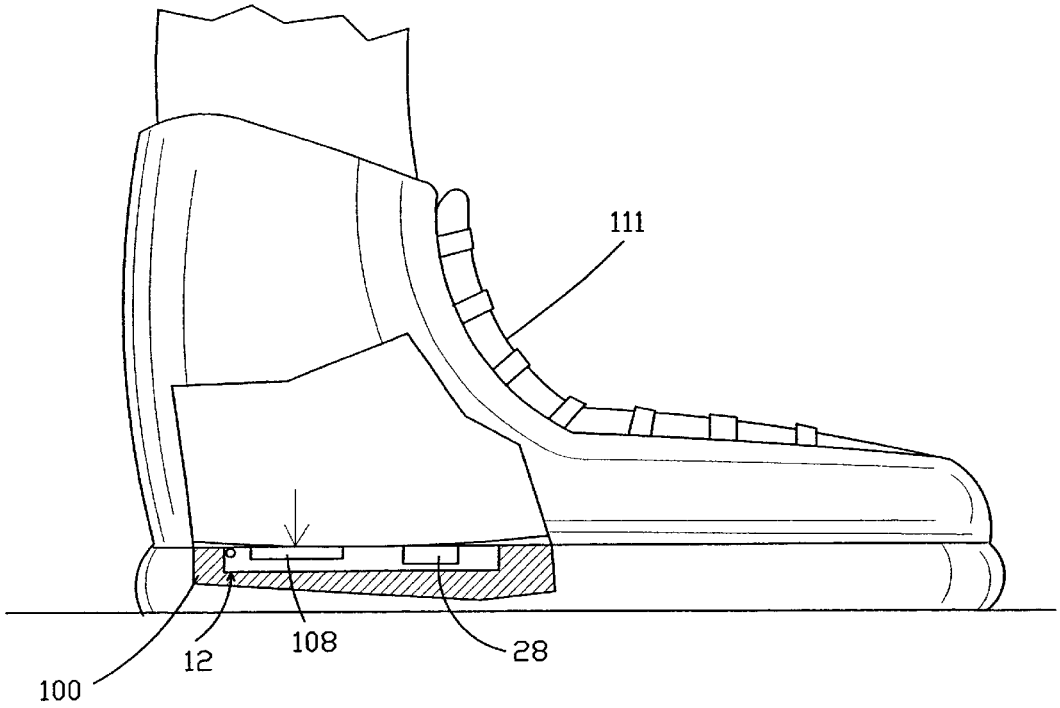
FIG. 9 is a side elevation of a shoe incorporating a personal tracking system according to the invention.
Figure 10:
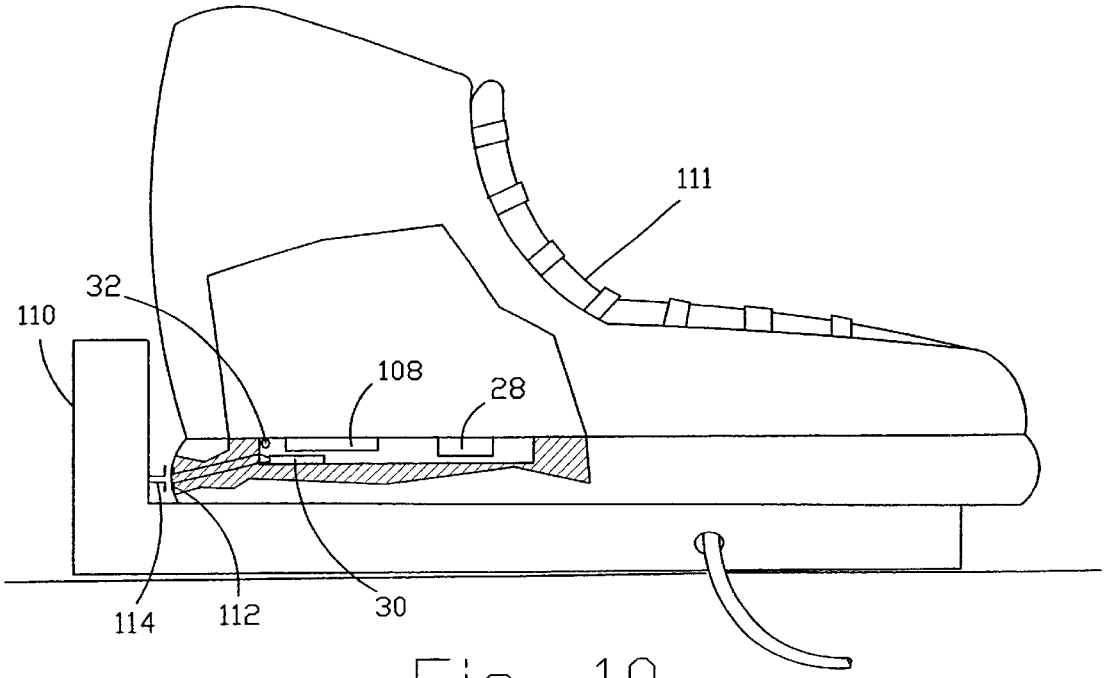
FIG. 10 is a side elevation of the shoe of FIG. 9 in combination with a charging unit.

As can best be seen in FIGS. 6, and 9–10, in a preferred embodiment, location unit 12 is concealed within a heel 100 of a shoe 111 to be worn by the person to be tracked. A pressure sensitive switch 108 may be incorporated into the location unit for turning the unit on and off depending on whether the person's foot is in the shoe. Using the pressure switch, the location unit is turned on when a person's foot is inserted into the shoe and applies pressure to the switch. The pressure switch will activate the location unit which will then automatically transmit location data to the web host. When the person's foot is removed, the pressure switch turns the location unit off to preserve batter power. In order to keep the location unit from constantly turning on and off as a person walks, or when the heel of the foot raises slightly from the shoe's insole, the pressure switch is allowed a travel distance of approximately half an inch. The travel distance should be such that as long as a person's foot remains in the shoe, the location unit will remain on. Any suitable pressure switch as is well within the purview of one skilled in the art may be utilized. Power source 30, in the form of a high-capacity rechargeable battery, may be recharged by placing the shoe in a charging cradle 110. For example, at night, when the individual is asleep, their shoe may be placed in cradle 110 for charging battery 30. For this purpose, charging contacts 112 are embedded in the shoe which mates with cradle contacts 114 during charging. Any suitable charging arrangement may be provided such as used with any cordless device, e.g., telephone, power tools, etc.

While a preferred embodiment of the invention has been described using specific terms, such description is for illustrative purposes only, and it is to be understood that changes and variations may be made without departing from the spirit or scope of the following claims.

What is claimed is:

1. A computerized system for locating and tracking a person by a system subscriber who maintains a remote computer terminal, said system comprising:

a web host connected to a wide area web network, said web host having a computer readable medium;

a shoe location unit for being carried by a shoe worn by the person for calculating the location of the shoe and person at any given time and transmitting a low power digital location data packet containing location data; and a computer program having instructions embodied in computer readable code residing on said web host for receiving a tracking request from the subscriber, transmitting a tracking call to said shoe location unit, receiving back said low power digital location data packet containing location data from said location unit representing the current position of the person automatically in response to said tracking request, and transmitting the location data regarding the current position of the shoe to said subscriber whereby the location of the person's shoe is displayed at the subscriber's terminal.

2. The system of claim 1 wherein said computer program includes:

input instructions for receiving said tracking request signal from the remote user via the Internet, said tracking request having a shoe location unit identification;

processing instructions for receiving said tracking request and processing and routing said tracking request;

communication instructions initializing wireless communication with the location unit;

location instructions responsive to said processing instructions for generating said tracking call and outputting said call to the location unit and for receiving said location data from said shoe location unit, and a display module for outputting said location data for display of the location unit's position by the the remote user via the Internet.

3. The system of claim 2 wherein said input instructions are contained in an input module, said communications instructions are contained in a communications module, said location instructions are contained in a location module, and said display instructions are contained in a display module; and including a main processing module for calling said communication, location, and display modules to carry out their respective instructions.

4. The system of claim 3 wherein validation instructions are contained in a validation module called by said main module.

5. The system of claim 1 wherein said computer readable instructions include:

formatting instructions for formatting said location data into a display map of the current location of the shoe location unit, and display instructions for outputting said map to the remote user via the Internet.

6. The system of claim 5 wherein said display map includes a position indicator indicating the current location of the shoe location unit.

7. The system of claim 1 wherein said tracking request includes a shoe unit identification number, and said computer readable instructions include validation instructions for comparing said unit identification number to an access code stored on said web host, and said instructions allowing said input instructions to generate said tracking call when said unit identification number corresponds to an authorized access code.

8. The system of claim 1 wherein said shoe location unit comprises:

an enclosure;

a location chip carried within the enclosure for receiving raw geo-position information;

a processor for receiving said raw geo-position information and generating said low power digital location data packet having location data representing the current position of the location unit and shoe;

a transceiver for transmitting said low power digital location data packet to a remote station in response to a call signal being received from said remote station;

said processor controlling said transceiver to transmit said low power digital location data packet in response to automatically answering said call signal from said remote station; and a power supply for supplying power to said location chip, said processor and said transceiver.

9. The system of claim 8 wherein said location chip is a GPS chip for receiving geo-position information from a global positioning system.

10. The system of claim 8 wherein a computer readable medium is included within said processor and including:

a set of computer instructions embodied in said computer readable medium wherein said instructions perform the steps of:

detecting a tracking request;

requesting tracking information signals from said location chip;

generating location data from said tracking information signals; and, providing said location data for transmission to a remote location.

11. The system of claim 10 wherein said instructions include means embodied in computer readable code for returning said processor to a standby mode after transmission of said location data to said remote location.

12. The system of claim 8 wherein said location data is embodied in a digital signal containing digital data only, and having no audio signal.

13. The device of claim 12 wherein said digital signal includes a digital record which includes access code data identifying a specific object to which the device is assigned, and location data.

14. The system of claim 1 where said shoe location unit is carried within one of a heel and sole of a person's shoe in an integral and inconspicuous manner.

15. The system of claim 14 including a pressure sensitive switch for turning the location unit off and on in response to the absence or presence of the person's foot being in the shoe, respectively.

16. The system of claim 14 including a rechargeable power source in said shoe location unit; and a charging cradle receiving said shoe in electrical mating contact for charging the power source.

17. A system for locating a person by a system subscriber wherein the person's shoe is provided with a shoe location unit which calculates the current location of the shoe and person at any given time, wherein said location unit includes a processor and transmitter to transmit a low power digital location data packet having location data, said system comprising:

a web host connected to a wide area web network, said web host having a computer readable medium;

said web host being accessible by the subscriber from a remote computer terminal;

a computer program residing on said web host for receiving a tracking request from the subscriber and transmitting a tracking call to the shoe location unit carried by the person's shoe; and said computer program including instructions embodied in computer readable code for automatically transmitting said tracking call, receiving the low power digital location data packet having location data from the location unit in response to said tracking call, and transmitting location data regarding the current position of the shoe and person to the subscriber's terminal where the current location of the person's shoe is displayed.

18. The system of claim 17 wherein said web host is accessible concurrently by a plurality of subscribers for sending out concurrent tracking calls to a plurality of respective shoe location units carried by person sought to be located.

19. The system of claim 17 wherein said computer readable instructions include:

input instructions for receiving said tracking request signal from the remote user via the Internet, said tracking request having a location unit identification;

processing instructions for receiving said tracking request and processing and routing said tracking request;

communication instructions initializing wireless communication with the shoe location unit;

location instructions responsive to said processing instructions for generating said tracking call and outputting said call to the shoe location unit and for receiving said location data from said location unit, and a display module for outputting said location data for display of the shoe location unit's position by the the remote user via the Internet.

20. The system of claim 17 wherein said computer readable instructions include:

formatting instructions for formatting said location data into a display map of the current location of the location unit, and display instructions for outputting said map to the remote user via the Internet.

21. The system of claim 20 wherein said display map includes a position indicator indicating the current location of the shoe location unit.

22. The system of claim 17 wherein said tracking request includes a unit identification number, and said computer readable instructions include:

validation instructions for comparing said unit identification number to an access code stored on said web host, and said instructions allowing said input instructions to generate said tracking call when said unit identification number corresponds to an authorized access code.

23. The system of claim 17 wherein said shoe location unit includes a computer processor having a computer readable medium and including:

a set of computer instructions embodied in said computer readable medium wherein said instructions perform the steps of:

detecting a tracking request;

requesting tracking information signals from said location chip;

generating location data from said tracking information signals; and, providing said location data for transmission to a remote location.

24. The system of claim 17 wherein said location data is embodied in a digital signal containing digital data only, and having no audio signal.

25. The system of claim 17 wherein said shoe location unit includes a processor and transceiver; and said processor including instruction embodied in computer readable code so that said shoe location unit automatically answers a tracking call, transmits said location data to said web host, hangs up, and returns to a standby mode.

26. A method for locating and tracking the position of a person's shoe, said method comprising:

providing a web host connectable to a plurality of subscriber terminals concurrently;

providing at least one shoe location units for affixation to at least one shoe worn by a person to be tracked;

receiving a tracking request at said web host initiated at said subscriber's terminal seeking the present location of a person's shoe;

transmitting a tracking call to the shoe location unit whose location is desired in response to receiving said tracking request;

receiving a low power digital data packet having location data at said web host from the shoe location unit representing the current location of the person's shoe in response to said tracking call; and transmitting said location data to the computer terminal of the subscriber for display of the current location of the person's shoe on the subscriber's terminal display.

27. The method of claim 26 including concealing said location unit in a portion of a shoe to be worn by a person.

28. The method of claim 27 including concealing the location unit in a heel of the shoe in an integral and inconspicuous manner; and providing a sensor which cuts the location unit off and on in response to detecting the absence or pressure of the person's foot, respectively.

29. The method of claim 26 including providing a rechargeable battery for powering the location unit and a shoe charging cradle for receiving the shoe in electrical contact to recharge the battery.

30. The method of claim 26 including providing a computer program residing on said web host for receiving a tracking request from the subscriber and transmitting a tracking call to the shoe location unit carried by the person's shoe; and said computer program includes the steps of automatically transmitting said tracking call, receiving said low power digital location data packet having location data from the shoe location unit in response to said tracking call, and transmitting the location data packet to the computer terminal of the subscriber where the current location of the person's shoe is displayed.

31. The method of claim 30 wherein said computer program includes instructions which include the steps of:

receiving said tracking request signal from the remote user via the Internet, said tracking request having a shoe location unit identification;

receiving said tracking request and processing and routing said tracking request;

initializing wireless communication with the location unit;

processing instructions for generating said tracking call and outputting said call to the location unit and for receiving said location data from said shoe location unit, and outputting said location data packet having location data for display of the location unit's current position by the remote user via the Internet.

32. The method of claim 26 including providing concurrent access to said web host from a plurality of subscribers for sending out concurrent tracking calls to a plurality of respective shoe location units carried by a person's shoe sought to be located.

33. A method for tracking persons wherein subscribers have computer terminals with a display comprising:

providing subscriptions to a web host accessible from a subscriber terminal;

assigning a shoe location unit to the person to be tracked by integrating the location unit with the person's shoe;

receiving a tracking request initiated at said subscriber terminal at said web host whereby a tracking call is transmitted from said web host to the shoe location unit assigned to the subscriber and location data representing the location of the person's shoe is transmitted to said web host from the shoe location unit; and transmitting said location data to said subscriber terminal so that the current location of the shoe and person can be displayed on the subscriber's terminal display.

34. The method of claim 33 including placing said location unit in the heel of a shoe in an integral inconspicuous manner.

35. The method of claim 34 including providing a rechargeable battery for said shoe location unit, and providing a shoe charging cradle for recharging the battery when the shoe is in the cradle.

* * * * *